US005813470A

United States Patent [19]

Radi

[11] Patent Number: 5,813,470

[45] Date of Patent: Sep. 29, 1998

[54] MEANS FOR RELIEVING LOAD ON STACKED CASING HANGERS

[75] Inventor: Amin Radi, Houston, Tex.

[73] Assignee: ABB Vetco Gray Inc., Houston, Tex.

[21] Appl. No.: 751,013

[22] Filed: Nov. 14, 1996

[51] Int. Cl.[6] ..... E21B 43/10

[52] U.S. Cl. ..... 166/382; 166/89.3; 166/208; 285/123.3

[58] Field of Search ..... 166/382, 75.14, 166/88.1, 89.1, 89.3, 208; 285/123.1, 123.2, 123.3

[56] References Cited

U.S. PATENT DOCUMENTS 3,297,344 1/1967 Hanes .
4,167,970 9/1979 Cowan ..... 285/123.3
4,460,042 7/1984 Galle, Jr. .
4,826,216 5/1989 Hynes et al. .
4,842,307 6/1989 Sweeney et al. .
4,919,460 4/1990 Milberger et al. .
5,044,432 9/1991 Cunningham et al. ..... 285/123.3 X
5,327,966 7/1994 Reimert .
5,464,063 11/1995 Boehm, Jr. .

*Primary Examiner*—William P. Neuder
*Attorney, Agent, or Firm*—James E. Bradley

[57] ABSTRACT

Using additional load shoulders on wellhead casing hangers when multiple casing hangers are needed increases the capacity of the casing hangers to withstand loads. The shoulders of the casing hangers are not required to land simultaneously. Either the upper or lower set of shoulders may contact prior to the other, with the first set to make contact plastically or elastically deforming to allow the other set to land. Other tubular members, such as a test plug may be inserted to pressure test the shoulders of the casing hanger for a casing string that is supported by the casing hanger.

22 Claims, 2 Drawing Sheets

MEANS FOR RELIEVING LOAD ON STACKED CASING HANGERS

BACKGROUND OF THE INVENTION

1. Field of the Invention:

This invention deals with oil and gas wellheads, and particularly with a means for supporting load on stacked casings hangers within a wellhead.

2. Description of the Prior Art:

In an oil or gas well, concentric strings of casing extend into the well, each being cemented in place. In one type of wellhead, each casing is supported at its upper end by a casing hanger. The casing hanger for the first string of casing lands on a load shoulder contained in the bore of the wellhead housing. The next casing hanger lands on top of the neck of the first casing hanger. similarly, if a third string of casing is run, the third casing hanger will land and be supported on top of the second casing hanger.

High loads are imposed on these casing hangers in high pressure wells. The load is due to internal pressure in the casing string exerting a downward force on the casing hanger. If adequate space exists in the bore, the casing hanger neck will be sized sufficiently thick to withstand the load imposed by the casing hanger or hangers supported on top. In some installations, however, inadequate room exists to provide an adequately thick casing hanger neck to withstand the desired loads. This occurs particularly where casing designed for use in a larger wellhead housing is supported within a smaller bore wellhead housing.

SUMMARY OF THE INVENTION

In this invention, the capacity of casing hangers to withstand desired loads is enhanced with the use of additional load shoulders on each casing hanger. A first casing hanger is supported within the bore of a wellhead housing by a coventional, exterior load shoulder. The casing hanger has a conventional or upper load shoulder to land a second casing hanger on top of its neck. A second lower shoulder protrudes radially inward from the first casing hanger inside its bore, thereby sharing the load when a second casing hanger is landed on it. In the preferred embodiment, the shoulders are conical. The second casing hanger has upper and lower exterior shoulders to land on the upper and lower shoulders of the first casing hanger. Similar to the first casing hanger, the second casing hanger has two shoulders upon which a third casing hanger may land, if needed. Multiple casing hangers may be landed in this manner to reach the desired depth in the well.

The shoulders of the casing hangers are not required to land simultaneously and either the upper or lower set of shoulders may contact prior to the other. If the lower shoulders make first contact, the lower shoulder of the first casing hanger will plastically deform before the upper shoulders make contact. If the upper shoulders make first contact, the upper shoulder of the first casing hanger will elastically deform before the lower shoulders make contact.

In a second embodiment, other tubular members may be landed in a manner similar to the second casing hanger. One example is a test plug. A test plug which is part of a test tool may be inserted to pressure test the casing hanger's seal.

DETAILED DESCRIPTION OF THE PREFERRED EMBODIMENT

Figure 1:
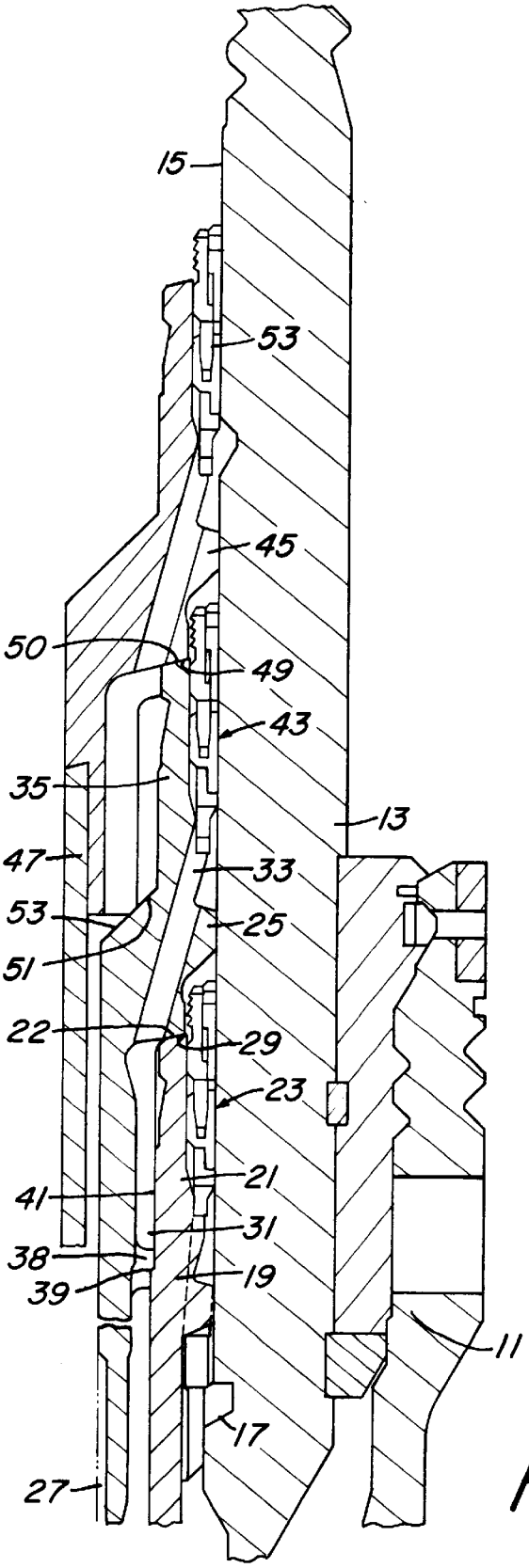
FIG. 1 is a quarter-sectional view illustrating a wellhead having casing hangers constructed in accordance with this invention.

Referring to FIG. 1, the wellhead shown includes an outer wellhead housing 11 which will be connected to conductor pipe which extends into the well to a first depth. An inner wellhead housing 13 lands within outer wellhead housing 11. Wellhead housing 13 is a high pressure tubular member which will be secured to a first string of casing that extends to a second depth in the well. Wellhead housing 13 has a bore 15 that contains an upward facing conical load shoulder 17. In the embodiment shown, load shoulder 17 is a separate ring of higher strength than the strength of the body of wellhead housing 11.

Figure 2:
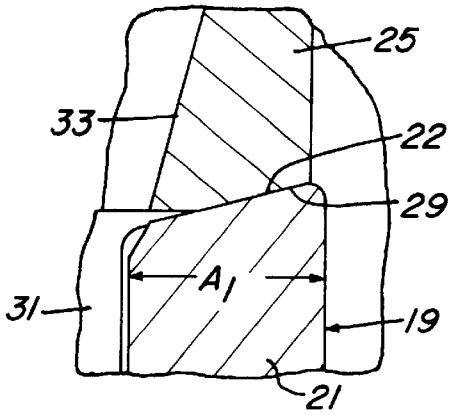
FIG. 2 is an enlarged sectional view of the upper end of the lowest casing hanger and the load shoulder of the intermediate casing hanger in contact with each other.

A first or lower casing hanger 19 is secured to a string of casing (not shown) that extends into the well and is cemented in place. Casing hanger 19 lands on load shoulder 17. Casing hanger 19 has a neck 21 that extends upward and is spaced radially inward from the wall of bore 15. A conventional casing hanger seal 23 locates in this space. Neck 21 has an upper end 22 which is a conical shoulder as shown in FIG. 2.

A second or intermediate casing hanger 25 is secured to another string of casing 27 which extends into the well and is cemented is place. Casing hanger 25 has an upper shoulder 29 which lands on shoulder 22 of first casing hanger 19. Second casing hanger 25 has flow channels 31 that extend along its exterior to join flow passages 33 that extend to the annular space surrounding neck 35. Passages 33 and channels 31 allow the return of fluid during cementing. A lower downward facing shoulder 37 is located on a protruding annular band 38 which is located on the exterior of casing hanger 25 at the lower end of flow channels 31. Lower shoulder 37 lands on an internal shoulder 39, shown in FIG. 2, which is formed in the bore 41 of lower casing hanger 19. A conventional casing hanger seal 43 is set between neck 35 and wellhead housing bore 15. In the preferred embodiment, shoulders 22, 39 are both conical. Lower shoulder 39 is shown to be at about a 45° angle while shoulder 22 is shown to be at about a 75° angle relative to the longitudinal axis. However, both angles may be the same.

Because of space requirements in this instance, the thickness of neck 21 is insufficient to provide the desired strength against the specified load from high pressure applied on it from intermediate casing hanger 25. Lower shoulder 39, however, provides additional strength to upper shoulder 22 so that when combined, shoulders 22, 39 will support the load. Generally, the ability to withstand the stress created by a downward acting axial load is proportional to the cross-sectional area A1 of neck 21, taken perpendicular to the axis, plus the area A2 of shoulder 39 taken perpendicular to the longitudinal axis. Shoulder 39 protrudes radially inward farther than neck 21 and is in an area of casing hanger 19 which has greater cross-sectional thickness than neck 21. The additional area A2 thus adds to the ability of casing hanger 19 to withstand the load.

Because of manufacturing tolerances, it is not practically possible for both shoulders 29, 37 to land simultaneously on their respective shoulders 22, 39. One of the shoulders 29, 37 will land prior to any contact of the other one. Then the casing hanger shoulder 22, 39 that is first in engagement with one of the shoulders 29, 37 must deflect axially downward before the second shoulder 29, 37 lands. The downward deflection can be either through plastic deformation or elastic deformation. In elastic deformation, the yield strength of the member is not exceeded. In plastic or permanent deformation, the yield strength is exceeded.

In one example of plastic deformation, the tolerances will be selected so that lower shoulder 37 contacts internal shoulder 39 before upper shoulder 29 contacts shoulder 22. Upon initial contact of shoulders 37, 39, a slight gap will exist between between shoulders 22, 29. The gap is small, such as 0.005 inches+/−0.005 inches. This small gap is selected so that the structural integrity of shoulder 39 is not compromised by axial plastic deformation of shoulder 39, rather the deflection will be a slight coining due to the bearing stress. The shear stress is kept low enough to avoid shearing of load shoulder 39. Once the deflection has occurred, shoulder 29 lands on shoulder 22 and continued deflection will cease.

In the case of elastic deflection, one way in which this could be achieved would be to size the tolerances so that shoulder 29 lands on shoulder 22 before shoulder 37 lands on shoulder 39. A slight gap would exist between shoulders 37 and 39 when shoulder 29 lands on shoulder 22. On an application of sufficient load, neck 21 flexes, causing shoulder 22 to move downward axially a slight amount until shoulders 37, 39 come into contact with each other. At this point, deflection ceases even though the same load is applied. The gap between shoulders 37, 39 must be small enough so that the yield strength of neck 21 is not exceeded before shoulders 37, 39 contact each other. Preferably, it is sized so that a safety factor which is a fraction of the yield is employed.

Calculating the deflection is handled by application of finite elements analysis or by standard calculations with a formula being following:

$$de=F/K$$

with K=A1E/L where de=elastic deflection

F=applied load, K=stiffness of the load path,

A1=cross sectional area of neck 21, E=Young's modulas of elasticity, L=length of the load path Motion of seal 23 due to axial deflection of neck 21 relative to wellhead housing 13 is of concern. Such motion imposed on seal 23 could adversely affect the performance of seal 23 for long term production applications because seal 23 is designed for static applications. Multiple load shoulders 22, 29 and 37, 39 reduce the deflection of neck 21 relative to housing 13. With a portion of the load bypassing neck 21 and passing through shoulders 37, 39 to housing 13, axial deflection on neck 21 is significantly reduced.

The same principles can be applied to additional casing hangers and other structures which are subjected to high pressure within a wellhead. For example, in FIG. 1, the additional structures include a third casing hanger 45 which lands on the intermediate casing hanger 25. Casing hanger 45 is secured to an inner string of casing 47 which extends to the maximum depth within the well. Casing hanger 45 has an upper shoulder 49 that lands on the upper end 50 of neck 35 of intermediate casing hanger 25. Casing hanger 45 has a lower shoulder 51 that lands on an internal shoulder 53 located within the bore of intermediate casing hanger 25. In this instance, because of the smaller diameter of casing 47 than casing 27, shoulder 53 is quite large in radial extent. Shoulder 51 need not extend the full extent of shoulder 53. The same analysis may be applied as previously discussed.

Because of the large radial dimension of shoulder 53, however, it is preferable to utilize elastic deformation of neck 35 rather than plastic deformation of shoulder 53. That is, the dimensions are selected so that shoulders, 49, 50 contact each other before shoulders 51, 53. A slight gap will exist. Upon the application of load, the gap closes due to axial deflection of neck 35. When the gap closes, load is shared through shoulders 51 and 53. A wellhead having three casing hangers may utilize permanent deformation in the instance of the engagement of intermediate casing hanger 25 with lower casing hanger 19, and elastic deformation is the case of the engagement of upper casing hanger 45 with intermediate casing hanger 25.

Figure 3:
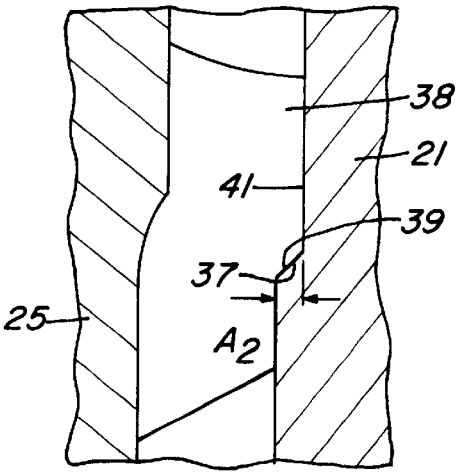
FIG. 3 is an enlarged sectional view of an internal load shoulder within the lowest casing hanger supporting an external shoulder on the intermediate casing hanger.
Figure 4:
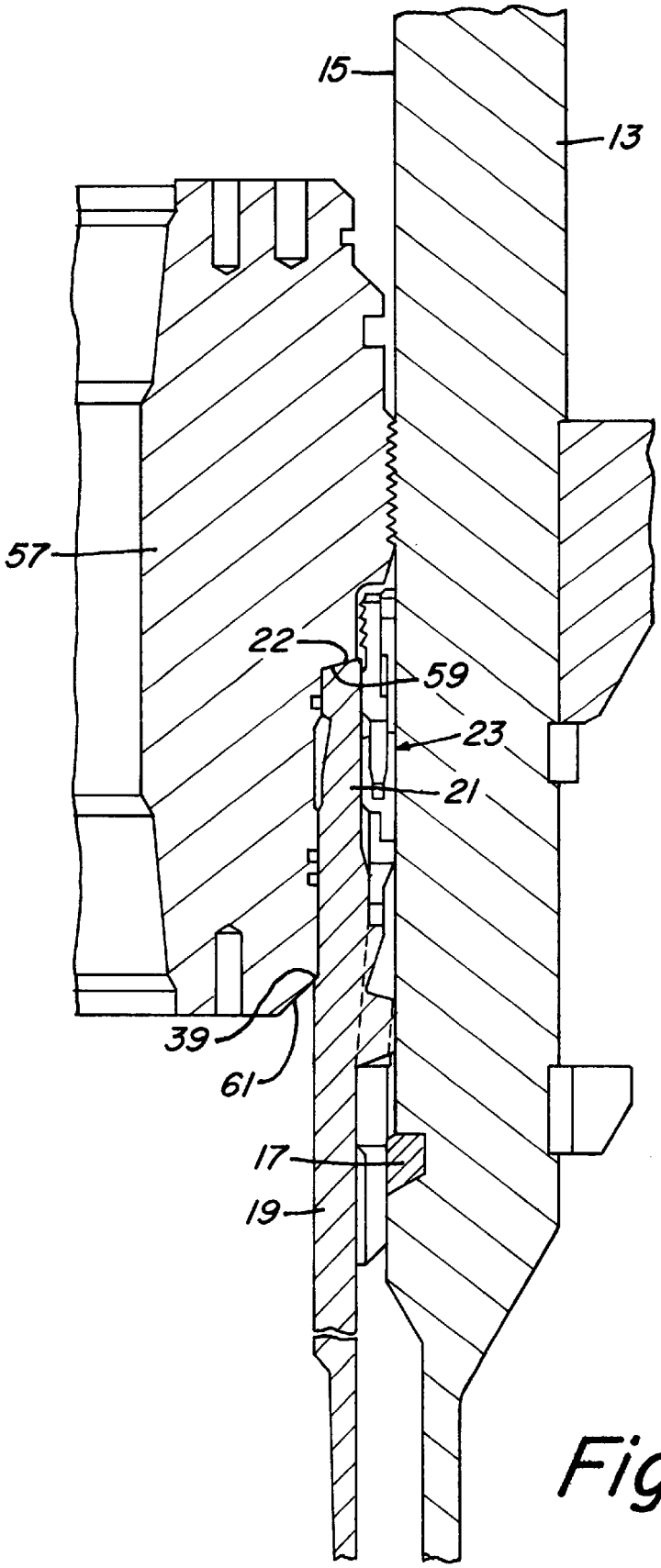
FIG. 4 is a quarter-sectional view illustrating a test plug located on the lowest casing hanger.

FIG. 3 illustrates the same principles applied to a device other than a casing hanger. In this example, prior to installing intermediate casing hanger 25 and upper casing hanger 45, a test plug 57 is inserted to pressure test the string supported by lower casing hanger 19. This test is of the blowout preventer stack using a test plug 57 which is part of a test tool. In the prior art, a test tool similar to test plug 57 would land only on a single shoulder such as on shoulder 22 of neck 21. Because extreme pressures would cause too much axial deflection of the thin neck 21, test plug 57 is provided not only with an upper shoulder 59, but also a lower shoulder 61. Lower shoulder 61 lands on internal shoulder 39 in the bore of casing hanger 19.

Again, either axial or plastic deformation will be employed as explained. Preferably, shoulder 61 will land on internal shoulder 39 first. Test pressure will cause plastic deformation of shoulder 39, bringing shoulder 59 into load supporting relationship with shoulder 22. Test plugs such as test plug 57 may also test multiple casing hangers such as the assembly shown in FIG. 1.

The invention has significant advantages. The use of multiple load shoulders results in a very high load bearing capacity wellhead system which avoids complicated mechanisms and expensive or exotic materials while controling the axial displacement of one component relative to the other. The invention is particularly advantageous where casing designed for use in a larger wellhead housing is supported within a smaller bore wellhead housing.

While the invention has been shown in only one of its forms, it should be apparent to those skilled in the art that it is not so limited, but is susceptible to various changes without departing from the scope of the invention.

I claim:

1. In a well assembly having a wellhead housing with a bore for receiving a tubular member, an improved apparatus for supporting a plurality of the tubular members, comprising in combination:

an upward facing load shoulder within the bore which supports a casing hanger which has a bowl and a neck with an upper end that forms a load bearing upper shoulder, and an internal, upward facing, lower shoulder which is formed in the bowl of the casing hanger; and a tubular member with a downward facing, upper shoulder and a downward facing lower shoulder that is radially inward farther than the upper shoulder of the tubular member, with the lower shoulder of the tubular member landing on the lower shoulder of the casing hanger, and the upper shoulder of the tubular member landing on the upper shoulder of the casing hanger.

2. The apparatus according to claim 1 wherein one set of the shoulders makes contact and lands before the other set of the shoulders.

3. The apparatus according to claim 1 wherein the two lower shoulders make contact and deform under load prior to the two upper shoulders making contact and sharing the load.

4. The apparatus according to claim 1 wherein the two lower shoulders make contact prior to the two upper shoulders making contact, and the lower shoulder of the casing hanger plastically deforms under load to allow the two upper shoulders to make contact and share the load.

5. The apparatus according to claim 1 wherein the two upper shoulders make contact and deform under load prior to the two lower shoulders making contact and sharing the load.

6. The apparatus according to claim 1 wherein the two upper shoulders make contact prior to the two lower shoulders making contact, and the neck of the casing hanger elastically deforms under load to allow the two lower shoulders to make contact and share the load.

7. The apparatus according to claim 1 wherein the tubular member is a test plug which is part of a test tool that is inserted to pressure test both the upper and lower shoulders of the casing hanger for a casing string that is supported by the casing hanger.

8. The apparatus according to claim 1 wherein the tubular member is a second casing hanger.

9. In a well assembly having a wellhead housing with a bore, the improvement comprising in combination:

an upward facing load shoulder within the bore which supports a first casing hanger which has a bore and a neck with an upper end that forms a load bearing upper shoulder, and an internal, upward facing, lower shoulder which is formed in the bore of the first casing hanger; and a second casing hanger with a downward facing, upper shoulder that lands on the upper shoulder of the first casing hanger, and a downward facing, lower shoulder landing on the lower shoulder of the first casing hanger.

10. The apparatus according to claim 9 wherein the lower shoulder of the second casing hanger is on a protruding annular band which is located on the exterior of the second casing hanger.

11. The apparatus according to claim 9 wherein one set of the shoulders makes contact and lands before the other set of the shoulders.

12. The apparatus according to claim 9 wherein the two lower shoulders make contact prior to the two upper shoulders making contact, and the lower shoulder of the first casing hanger plastically deforms under load to allow the two upper shoulders to make contact and share the load.

13. The apparatus according to claim 9 wherein the two upper shoulders make contact prior to the two lower shoulders making contact, and the neck of the first casing hanger elastically deforms under load to allow the two lower shoulders to make contact and share the load.

14. The apparatus according to claim 9 wherein a third casing hanger has a downward facing, upper shoulder that lands on a upper end of the neck of the second casing hanger, and the third casing hanger has a downward facing lower shoulder that lands on an internal, lower shoulder of the second casing hanger.

15. The apparatus according to claim 9 wherein the shoulders are substantially conical.

16. In a well assembly having an inner wellhead housing which is connected to a conduit and which has a bore for receiving a plurality of casing hangers, the improvement comprising in combination:

an upward facing load shoulder within the bore on which lands a first casing hanger, the first casing hanger being secured to a first string of casing that extends into the well, the first casing hanger having a bore and a neck with an upper end that forms an upper shoulder, and an internal, upward facing, lower shoulder which is formed in the bore; and a second casing hanger is secured to a second string of casing which extends into the well interior to the first string, and is sealed with a second conventional casing hanger seal. The second casing hanger has a downward facing, upper shoulder that lands on the upper shoulder of the first casing hanger, and a downward facing, lower shoulder located on a protruding annular band which is located on the exterior of the second casing hanger, with the lower shoulder of the second casing hanger landing on the lower shoulder of the first casing hanger; and a third casing hanger is secured to a third string of casing which extends into the well interior to the second string, and is sealed with a third conventional casing hanger seal. The third casing hanger has a downward facing, upper shoulder that lands on an upper end of a neck of the second casing hanger, and a downward facing, lower shoulder that lands on an internal lower shoulder of the second casing hanger.

17. The apparatus according to claim 16 wherein the lower shoulders make contact and land prior to the upper shoulders making contact.

18. A method of installing and supporting a plurality of tubular members for a well in a wellhead, comprising:

providing an upward facing load shoulder within a bore in a wellhead housing;

providing a casing hanger which has a bowl and a neck with an upper end that forms an upper shoulder, and an internal, upward facing, lower shoulder which is formed in the bowl of the casing hanger;

providing a tubular member with a downward facing, upper shoulder and a downward facing, lower shoulder that is radially inward farther than the upper shoulder of the tubular member;

landing the tubular member, with the upper shoulder of the tubular member landing on the upper shoulder of the casing hanger, and the lower shoulder of the tubular member landing on the lower shoulder of the casing hanger.

19. The method according to claim 18, wherein the step of landing the tubular member consists of contacting the lower shoulder of the tubular member with the lower shoulder of the casing hanger prior to the two upper shoulders making contact, the lower shoulder of the casing hanger plastically deforming under load to allow the two upper shoulders to make contact and share the load.

20. The method according to claim 18, wherein the step of landing the tubular member consists of contacting the upper shoulder of the tubular member with the upper shoulder of the casing hanger prior to the two lower shoulders making contact, the neck of the casing hanger elastically deforming under load to allow the two lower shoulders to make contact and share the load.

21. The method according to claim 18, wherein the step of providing a tubular member comprises providing a test plug which is part of a test tool and the method of pressure testing the casing hanger.

22. The method according to claim 18, wherein the step of providing a tubular member comprises providing a second casing hanger.

* * * * *

UNITED STATES PATENT AND TRADEMARK OFFICE

CERTIFICATE OF CORRECTION

PATENT NO. : 5,813,470
DATED : September 29, 1998
INVENTOR(S) : Amin Radi

It is certified that error appears in the above-identified patent and that said Letters Patent is hereby corrected as shown below:

Column 6, Line 6, delete "is";

Column 6, Line 9, after "seal" delete ". The" and insert --, the--;

Column 6, Line 9 after "hanger" delete "has" and insert --having--;

Column 6, Line 17, delete "is";

Column 6, Line 20, after "seal" delete ". The" and insert --, the--;

Column 6, Line 20, after "hanger" delete "has" and insert --having--.

Signed and Sealed this

Fourth Day of May, 1999

*Attest:*

Q. TODD DICKINSON

*Attesting Officer*

*Acting Commissioner of Patents and Trademarks*